US010919665B2

(12) United States Patent
Robbins et al.

(10) Patent No.: US 10,919,665 B2
(45) Date of Patent: Feb. 16, 2021

(54) PALLET WITH THERMAL ENERGY STORAGE

(71) Applicant: Viking Cold Solutions, Inc., Houston, TX (US)

(72) Inventors: Paul Robbins, Houston, TX (US); Michael P. Crisman, Houston, TX (US); Roger Ansted, Houston, TX (US); Andres Barron, Houston, TX (US); Robert Reyes, Houston, TX (US); Sandra Jameson, Houston, TX (US)

(73) Assignee: Viking Cold Solutions, Inc., Houston, TX (US)

( * ) Notice: Subject to any disclaimer, the term of this patent is extended or adjusted under 35 U.S.C. 154(b) by 126 days.

(21) Appl. No.: 15/726,945

(22) Filed: Oct. 6, 2017

(65) Prior Publication Data

US 2018/0099778 A1 Apr. 12, 2018

Related U.S. Application Data

(60) Provisional application No. 62/405,054, filed on Oct. 6, 2016.

(51) Int. Cl.
*B65D 19/38* (2006.01)
*B65D 19/00* (2006.01)
(Continued)

(52) U.S. Cl.
CPC ..... *B65D 19/38* (2013.01); *B65D 19/0018* (2013.01); *B65D 19/0028* (2013.01); *B65D 19/0038* (2013.01); *B65D 81/3813* (2013.01); *F25D 3/06* (2013.01); *B65D 2519/00029* (2013.01); *B65D 2519/00034* (2013.01); *B65D 2519/00044* (2013.01); *B65D 2519/00064* (2013.01); *B65D 2519/00069* (2013.01);
(Continued)

(58) Field of Classification Search
CPC ..... B65D 19/38; B65D 19/0018; B65D 19/0028; B65D 19/0038; B65D 81/3813; F25D 3/06
See application file for complete search history.

(56) References Cited

U.S. PATENT DOCUMENTS 3,913,559 A * 10/1975 Dandliker ..... A61F 7/03 126/263.07
4,377,075 A * 3/1983 Russo ..... B65D 81/18 62/372

(Continued)

FOREIGN PATENT DOCUMENTS

| | | |
|---|---|---|
| DE | 29922049 U1 | 4/2000 |
| DE | 102012022398 A1 | 5/2014 |
| EP | 1818271 A1 | 8/2007 |

OTHER PUBLICATIONS

International Search Report and Written Opinon issued in corresponding International Application No. PCT/US2017/055527 dated Jan. 16, 2018 (14 pages).

*Primary Examiner* — Ljiljana V. Ciric
(74) *Attorney, Agent, or Firm* — Duane Morris LLP

(57) ABSTRACT

A pallet for shipping goods, where the pallet includes a rigid member, a phase change material, and a temperature indicator. The rigid member further includes a phase change material compartment which contains the phase change material.

13 Claims, 7 Drawing Sheets

(51) Int. Cl.
*B65D 81/38* (2006.01)
*F25D 3/06* (2006.01)

(52) U.S. Cl.
CPC ..... *B65D 2519/00079* (2013.01); *B65D 2519/0094* (2013.01); *B65D 2519/00268* (2013.01); *B65D 2519/00273* (2013.01); *B65D 2519/00288* (2013.01); *B65D 2519/00293* (2013.01); *B65D 2519/00318* (2013.01); *B65D 2519/00323* (2013.01); *B65D 2519/00333* (2013.01); *B65D 2519/00338* (2013.01); *F25D 2303/0845* (2013.01)

(56) References Cited

U.S. PATENT DOCUMENTS 4,579,170 A * 4/1986 Moses ..... F25D 3/00 165/104.17
4,619,678 A * 10/1986 Rubin ..... A61B 10/0096 422/944
5,647,226 A * 7/1997 Scaringe ..... C09K 5/066 62/371
5,669,233 A * 9/1997 Cook ..... B65D 19/06 62/371
5,687,652 A * 11/1997 Ruma ..... B65D 19/0026 108/57.25
5,899,088 A * 5/1999 Purdum ..... B65D 81/056 62/371
6,079,404 A * 6/2000 Salyer ..... C09K 5/063 126/206
6,266,972 B1 * 7/2001 Bostic ..... F25D 3/06 62/371
6,482,332 B1 * 11/2002 Malach ..... C09K 5/066 165/10
6,659,020 B1 * 12/2003 Ball ..... B65D 19/0048 108/57.28
7,516,600 B1 * 4/2009 Flora ..... B65B 25/00 53/449
7,544,262 B2 * 6/2009 Dummett ..... B29C 44/569 108/901
7,908,870 B2 * 3/2011 Williams ..... F25D 3/08 62/530
7,963,397 B2 * 6/2011 Seagle ..... B65D 19/18 206/600
8,215,835 B2 * 7/2012 Hyde ..... A61J 1/165 374/208
8,443,623 B2 * 5/2013 Matta ..... B29C 44/14 62/457.2
8,651,027 B2 * 2/2014 Huang ..... B32B 7/12 108/55.5
9,138,945 B2 * 9/2015 Rimmer ..... B29C 44/0461
9,180,998 B2 * 11/2015 Banks ..... B65D 19/02
9,366,469 B2 * 6/2016 Chapman, Jr. ..... F25D 3/08
9,513,067 B2 * 12/2016 Ahmed ..... B65D 19/06
9,531,172 B1 * 12/2016 Fakhari ..... H02G 3/00
9,748,548 B2 * 8/2017 Malcolm ..... H01M 2/206
9,751,682 B2 * 9/2017 Mayer ..... B65D 81/3825
RE46,708 E * 2/2018 Karamanos
9,927,169 B2 * 3/2018 Baker ..... B01L 7/52
10,000,329 B2 * 6/2018 Knight ..... B65D 81/3823
10,287,054 B2 * 5/2019 Imbrecht ..... B65D 19/18
10,357,906 B2 * 7/2019 Johnson, Sr. ..... B29C 48/07
10,518,931 B2 * 12/2019 Weeks ..... B65D 19/0018
10,562,667 B2 * 2/2020 Lin ..... B65D 19/0018
10,562,694 B2 * 2/2020 Austerberry ..... F25D 23/06
10,562,695 B2 * 2/2020 Knight ..... B29D 99/0096
10,583,978 B2 * 3/2020 Longley ..... F28D 20/02
10,604,326 B2 * 3/2020 Longley ..... B65D 19/38
10,661,969 B2 * 5/2020 Pranadi ..... B65D 19/06
10,683,136 B2 * 6/2020 Imbrecht ..... B65D 19/0026
10,689,153 B2 * 6/2020 Segerstrom ..... B65D 19/0095
2002/0099567 A1 * 7/2002 Joao ..... G06Q 10/083 340/539.13
2004/0079793 A1 * 4/2004 Mayer ..... B65D 81/3816 229/103.11
2004/0079794 A1 * 4/2004 Mayer ..... B65D 81/3816 229/103.11
2004/0226309 A1 * 11/2004 Broussard ..... F25D 11/003 62/236
2005/0196584 A1 * 9/2005 Halecki ..... B32B 27/36 428/100
2006/0023480 A1 * 2/2006 Plummer ..... B60H 1/00278 363/146
2006/0071774 A1 * 4/2006 Brown ..... G06Q 10/087 340/522
2007/0188372 A1 * 8/2007 Leath ..... G01K 11/006 342/26 R
2008/0114487 A1 * 5/2008 Schuler ..... G06Q 10/06 700/217
2008/0135564 A1 * 6/2008 Romero ..... B65D 81/3827 220/592.2
2009/0183514 A1 * 7/2009 Holmes ..... F25D 3/125 62/51.1
2010/0301057 A1 * 12/2010 Tattam ..... B65D 88/528 220/592.25
2011/0121246 A1 * 5/2011 Biggin ..... C04B 28/32 252/601
2011/0210954 A1 * 9/2011 Murphy ..... H01M 10/0525 345/211
2012/0197810 A1 * 8/2012 Haarmann ..... G06Q 30/012 705/302
2012/0280814 A1 * 11/2012 Beale ..... G01D 9/005 340/540
2013/0014676 A1 1/2013 Imbrecht et al.
2013/0015191 A1 * 1/2013 Seagle ..... B65D 19/18 220/592.01
2013/0015192 A1 * 1/2013 Seagle ..... B32B 27/065 220/592.01
2013/0120910 A1 * 5/2013 Watanabe ..... H01G 9/155 361/517
2013/0240385 A1 * 9/2013 Loehrke ..... H01M 2/1005 206/205
2014/0190976 A1 * 7/2014 Imbrecht ..... B65D 19/18 220/592.01
2015/0037647 A1 * 2/2015 Nguyen ..... H01M 10/625 429/120
2015/0053086 A1 * 2/2015 Rebouillat ..... B32B 7/02 96/11
2015/0232266 A1 * 8/2015 Ahmed ..... B65D 88/744 220/592.01
2015/0239639 A1 8/2015 Wenner et al.
2015/0241120 A1 * 8/2015 Mayer ..... G06Q 50/28 62/62
2015/0276297 A1 * 10/2015 Moore ..... B65D 81/18 62/4
2015/0284169 A1 * 10/2015 Nehring ..... B65D 19/18 220/592.25
2015/0353269 A1 * 12/2015 Sato ..... B65D 85/38 206/316.1
2015/0360809 A1 * 12/2015 McBride ..... B65D 19/0095 108/57.19
2016/0012310 A1 * 1/2016 Kozicki ..... G02B 21/06 382/218
2017/0096283 A1 * 4/2017 Longley ..... F28F 23/00
2017/0121097 A1 * 5/2017 Pranadi ..... B65D 19/06
2017/0197752 A1 * 7/2017 Imbrecht ..... B65D 19/44
2018/0093816 A1 * 4/2018 Longley ..... B65D 81/3897
2018/0286035 A1 * 10/2018 Kozicki ..... G07D 7/2033
2018/0370681 A1 * 12/2018 Lin ..... B65D 19/0026
2020/0108997 A1 * 4/2020 Austerberry ..... B65D 25/30
2020/0180845 A1 * 6/2020 MokhtarzadehBahadorani ..... A61J 1/00
2020/0292223 A1 * 9/2020 Tansley ..... F25D 3/06

* cited by examiner

PALLET WITH THERMAL ENERGY STORAGE

BRIEF DESCRIPTION OF DRAWINGS

Certain embodiments of the invention will be described with reference to the accompanying drawings. However, the accompanying drawings illustrate only certain aspects or implementations of the invention by way of example and are not meant to limit the scope of the claims.

DETAILED DESCRIPTION

Specific embodiments will now be described with reference to the accompanying figures. In the following description, numerous details are set forth as examples of the invention. It will be understood by those skilled in the art that one or more embodiments of the present invention may be practiced without these specific details and that numerous variations or modifications may be possible without departing from the scope of the invention. Certain details known to those of ordinary skill in the art are omitted to avoid Obscuring the description.

In general, embodiments of the invention relate to devices, systems, and/or methods for temperature control. When goods are shipped, the goods may be loaded onto a pallet. During shipping, the pallet and goods may be exposed to ambient conditions that cause the temperature of the goods to change due to heat exchange between the goods and the ambient conditions. Changing the temperature of the goods during shipping may degrade a quality of the goods. For example, the shelf life of fresh produce may be greatly degraded if the temperature of the produce is not maintained during shipping.

A pallet in accordance with embodiments of the invention may store thermal energy and thereby regulate the temperature of the goods during shipping. The pallet may include a quantity of phase change material that has a liquid to solid phase transition temperature at or near a regulating temperature of the goods. If the goods and the pallet are exposed to ambient conditions that causes heat exchange, the quantity of phase change material may absorb heat or release heat and melt or solidify, respectively. Absorbing or releasing heat by the quantity of phase change material may maintain the goods at/near the regulation temperature by at least reducing the effects of the heat exchange. For example, the phase change material may reduce the fractional contribution of the heat exchange effect on the goods.

Figure 1:
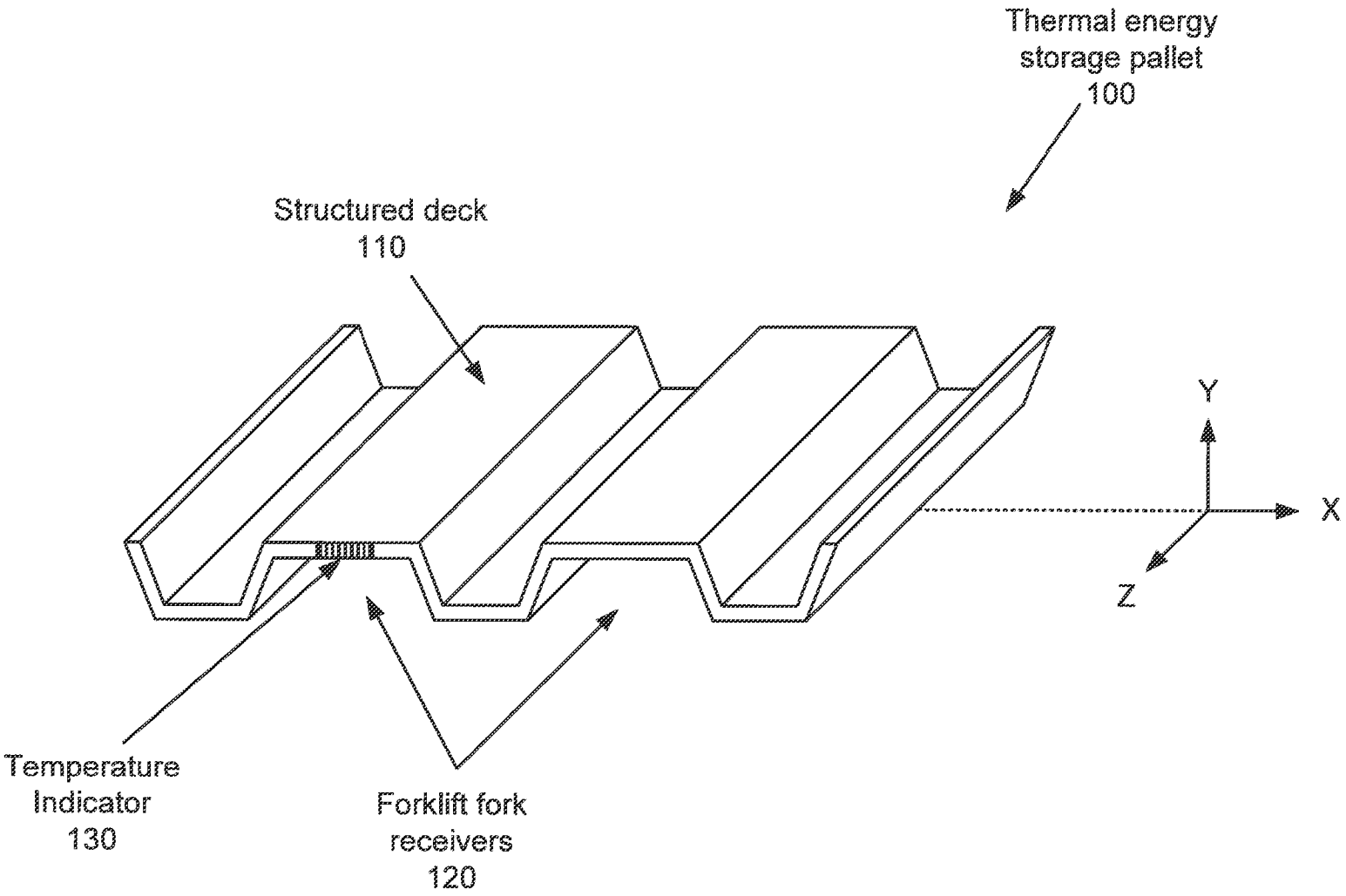
FIG. 1 shows an isometric diagram of a thermal energy storage pallet in accordance with one or more embodiments of the invention.

FIG. 1 shows a thermal energy storage pallet (100) in accordance with one or more embodiments of the invention. The thermal energy storage pallet (100) may regulate the temperature of goods disposed on the pallet. In one or more embodiments, the thermal energy storage pallet (100) may regulate the temperature of the goods by at least reducing the effects of heat exchange with an ambient environment while the goods are shipped and/or stored. The thermal energy storage pallet (100) may thermally protect the goods by sharing a significant portion of the effect of heat exchange between the goods and an ambient environment. The thermal energy storage pallet (100) may include a quantity of phase change material that changes state in response to heat exchange between the goods and/or the pallet and the environment surrounding the pallet. Changing state may regulate the temperature of the goods disposed on the thermal energy storage pallet.

The thermal energy storage may include a structured deck (110), forklift fork receivers (120), and a temperature indicator (130). Each of the components of the system are described below.

The structured deck (110) may be a platform or other structure on which goods may be disposed. Goods may be placed and/or secured to the structured deck (110) during shipping. The structured deck (110) may be formed of rigid and/or semi-rigid materials to provide torsion and tensile strength sufficient to support the weight of goods disposed on the structured deck (110).

The structured deck (110) may include phase change material disposed within the structured deck (110). The structure deck (110) may include voids, hollow portions, or other structures for storing of phase change material. For additional details regarding the structured deck (110) see FIG. 2. For additional examples of structured decks see FIGS. 4 and 5.

The forklift fork receivers (120) may be recesses, voids, or other structures for receiving forks of a forklift or other device for transporting structures. In some embodiments of the invention, the thermal energy storage pallet (100) may include two forklift fork receivers (120), as seen in FIG. 1, that traverse a length of the thermal energy storage pallet (100). By including two forklift fork receivers (120) that traverse the length of the pallet, the thermal energy storage pallet may be picked up by a forklift from either side by inserting the forks at either end of the length of the pallet. The thermal energy storage pallet (100) may include any number of forklift fork receivers (120) without departing from the invention. For additional examples of forklift fork receivers, see FIG. 3.

The temperature indicator (130) may be a physical device that indicates a thermal state of the thermal energy storage pallet (100). The thermal state of the thermal energy storage pallet (100) indicates a ratio of a portion a phase change material disposed within the pallet that is in a desired state, e.g., solid, to a second portion of the phase change material that is not in the desired state, e.g., liquid.

In one or more embodiments of the invention, the temperature indicator (130) may be a passive device. For example, the temperature indicator (130) may be a thermal chromic device that changes color depending on the temperature. In another example, the temperature indicator (130) may be a thermometer that displays a temperature.

In one or more embodiments of the invention, the temperature indicator (130) may be a physical computing device operably connected to a temperature sensor. The computing device may be, for example, an embedded system, a system on a chip, or a microcontroller. The computing device may be another type of device without departing from the invention.

The computing device may include a processor operably connected to a non-transitory computer readable storage medium (CRM) for storing instructions. The instructions stored on the non-transitory CRM, when executed by the processor, may cause the computing device to periodically measure a thermal state of the thermal energy storage pallet (100) via the temperature sensor. The computing device may relay, display, or otherwise convey the thermal state of the thermal energy storage pallet (100) to a user. The computing device may also store, during shipping, the thermal state of the pallet during the shipping (e.g., a series of time stamped entries that specify thermal state). Once the shipping is complete, the computing device may relay, display, or otherwise convey the thermal state of the thermal energy storage pallet (100) to the user during the shipping.

In one or more embodiments of the invention, the computing device may include a positioning system. The positioning system may be a physical device that reports a position of the thermal energy storage pallet (100) to the computing device. The positioning system may be, for example, a global positioning system receiver that determines a position based on one or more received electromagnetic signals. The computing device may store, during shipping, the position of the thermal energy storage during the shipping (e.g., a series of time stamped entries that specify a position, location, or other geographic information). Once the shipping is complete, the computing device may relay, display, or otherwise convey the position of the thermal energy storage pallet to a user during the shipping.

In one or more embodiments of the invention, the computing device may include a cellular transceiver, a satellite transceiver, and/or another type of wireless communication system transceiver. The transceiver may be operable connected to a communications system and thereby enable the computing device to exchange data with other devices connected to the communication system. The communication system may also be connected with the internet and thereby enable the computing device to exchange data with any device connected to the internet.

In one or more embodiments of the invention, the computing device may be connected to a user device via the communication system. The user device may be, for example, a cellular phone, a tablet computer, a desktop computer, a server, a high performance computing system, a cloud service, or any other type of device reachable via internet or a communication system. The computing device may convey the thermal state and/or the position of the thermal energy storage pallet to the user device by way of the communication system. Thus, the computing device may relay, display, or otherwise convey information to a user via the user device.

While the temperature sensor is described as being operably connected to a computing device, embodiments of the invention are not limited to a temperature sensor operating as a slave device. In one or more embodiments of the invention, the temperature sensor may be autonomous device including a communication system transceiver. The temperature sensor may be programmed to periodically relay the thermal state of the thermal energy storage pallet to a user device via a communication system using the transceiver. In other words, in some embodiments of the invention the temperature sensor may relay measurement to a remote monitoring system accessible by a user. The access may be directly, e.g., directly to a system, or indirectly, e.g., through a web portal, thin client, network connection, or other indirect method.

While not shown in FIG. 1, the thermal energy storage pallet (100) may include access ports for receiving phase change material. The access ports (100) may be apertures or other structures for access an internal volume of the pallet where phase change material may be stored. Thus, phase change material may be placed into the interior of the pallet via the access ports. The access ports may be reusable, e.g., able to be opened and closed, or one time use, e.g., once closed form a hermetic seal.

Figure 2:
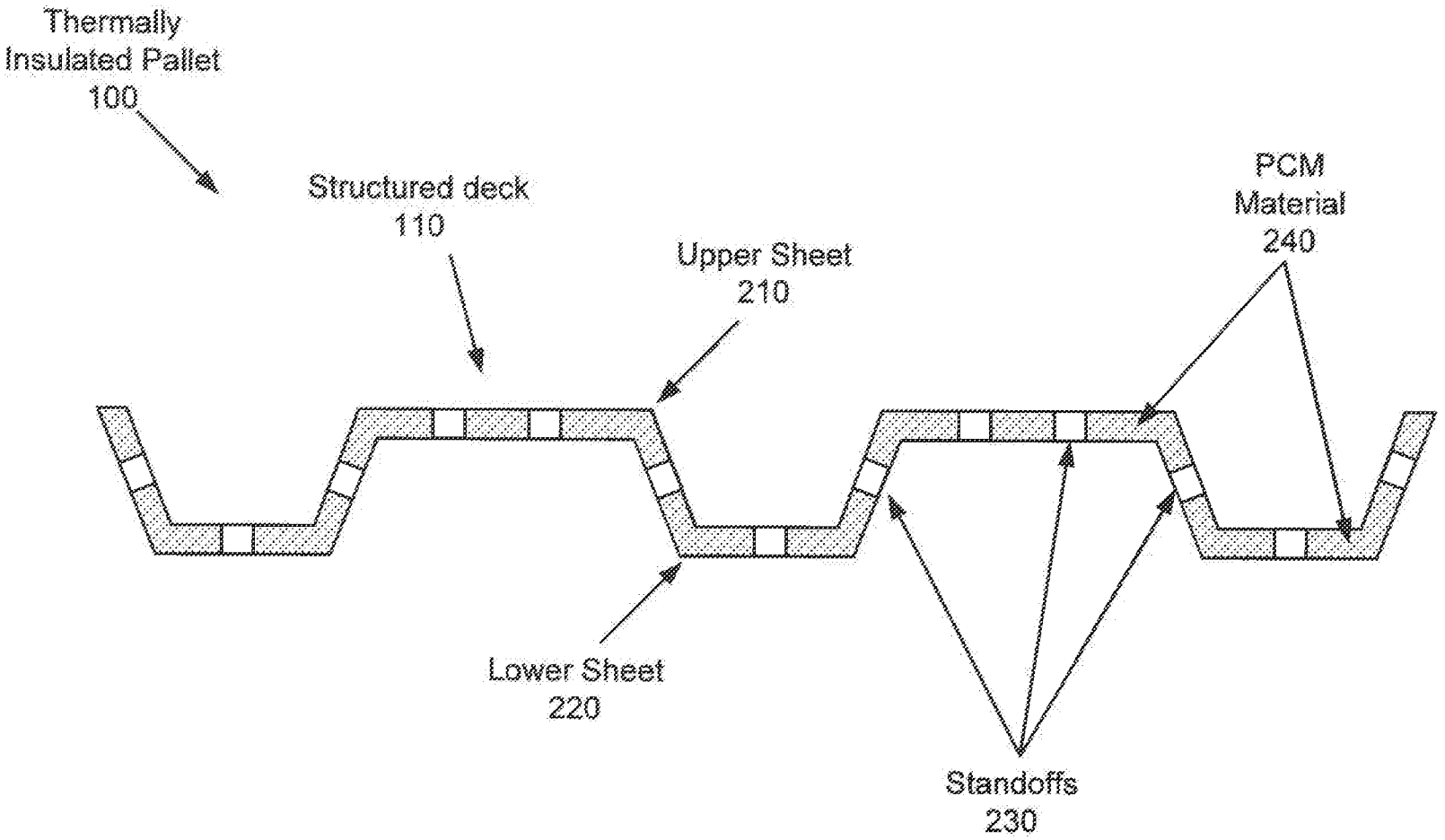
FIG. 2 shows a cross section diagram of a thermal energy storage pallet in accordance with one or more embodiments of the invention.

FIG. 2 shows a cross section diagram of a thermal energy storage pallet (100) in accordance with embodiments of the invention. The cross section shown in FIG. 2 is taken along the X-Y plane shown in FIG. 1. As seen from FIG. 2, the structured deck (110) may include an upper sheet (210), a lower sheet (220), standoffs (230), and phase change material (240). Each of the components of the system is described below.

The upper sheet (210) and lower sheet (220) may be rigid or semi-rigid members that impart torsional and tensile strength to the thermal energy storage pallet (100). In one or more embodiments of the invention, the upper sheet (210) and lower sheet (220) may be a plastic material. The plastic material may be, for example, Teflon, nylon, polystyrene, polypropylene, polyethylene, high density polyethylene, or acrylonitrile butadiene styrene. The sheets may be other plastics without departing from the invention.

Each of the sheets may have a shape that forms the structured deck (110) and the forklift fork receivers (120). For example, sheets of plastic may be molded into shapes that includes a deck and recesses for receiving forks that enable the thermal energy storage pallet (100) to be picked up by a forklift.

Each of the sheets may be separated from each other and thereby form a hollow portion or cavity between the sheets. While the sheets shown in FIG. 2 are illustrated as being at a fixed distance from each other, embodiments of the invention includes sheets that have a distance between each other that vary. For example, the distance between the sheets may become larger or smaller along the length of the sheet to form a hollow portion or cavity that varies across the length and width of the thermal energy storage pallet (100).

Standoffs (230) and phase change material (240) may be disposed within the hollow portion or cavity to impart structural strength and thermal storage capacity, respectively.

The standoffs (230) may be structural members. For example, the standoffs (230) may be posts, blocks, honeycomb, or any other type of structural members. Each of the standoffs may be disposed between the upper sheet (210) and the lower sheet (220). In some embodiments of the invention, the standoffs (230) may be attached to each of the sheets. In one or more embodiments of the invention, the standoffs (230) may be a plastic material. The plastic material may be, for example, Teflon, nylon, polystyrene, polypropylene, polyethylene, high density polyethylene, or acrylonitrile butadiene styrene. The standoffs (230) may be other plastics and/or other materials without departing from the invention.

The standoffs (230) may add structural strength to the thermal energy storage pallet. For example, the standoffs (230) may maintain separation between the upper sheet (210) and lower sheet (220) when forces are applied to the thermal energy storage pallet (100). For example, goods disposed on thermal energy storage pallet may apply force to the thermal energy storage pallet (100). Placement of standoffs (230) between the upper sheet (210) and lower sheet (220) provide sufficient structural strength to the sheets so that the thermal energy storage pallet (100) does not deform or break in response to the forces applied by goods disposed on the pallet (100).

The phase change material (240) may be a material having a configurable liquid phase to solid phase transition temperature. Transitioning from a solid to a liquid or a liquid to a solid may absorb or release heat, respectively. Releasing or absorbing heat may regulate a temperature of a good disposed near the phase change material.

In one or more embodiments of the invention, the liquid phase to solid phase transition temperature may be configured based on a regulation temperature during shipping. For example, for goods that are to be regulated at a temperature of 32° Fahrenheit, the liquid phase to solid phase transition temperature may be set to 32° Fahrenheit.

In one or more embodiments of the invention, the liquid phase to solid phase transition temperature may be configured based on a regulation temperature of a cooling system that is used to maintain the temperature of the goods during shipping. For example, for a cooling system that has a regulation temperature of 32° Fahrenheit, the liquid phase to solid phase transition temperature of the phase change material may be set to 28° Fahrenheit.

In one or more embodiments of the invention, the phase change material may be configured to not leak out of the thermal energy storage pallet in the event of a penetration, or other mechanical modification of the thermal energy storage pallet. For example, phase change material may be disposed in an internal cavity or other structure of the thermal energy storage pallet. During use, a fork of a forklift may be pressed against the thermal energy storage pallet with sufficient pressure to penetrate the thermal energy storage pallet. Penetrating the thermal energy storage pallet may result in the formation of a passage way or other structure that may allow phase change material to leak out of the thermal energy storage pallet via the passage way if the phase change material is not configured to not leak out of the thermal energy storage pallet.

In one or more embodiments of the invention, the phase change material may be a liquid having a viscosity that prevents the phase change material from leaking out of thermal energy storage pallet. In one or more embodiments of the invention, the liquid may have a viscosity of greater than 100 centipoise. In one or more embodiments of the invention, the liquid may have a viscosity of greater than 1000 centipoise. In one or more embodiments of the invention, the liquid may have a viscosity of greater than 5000 centipoise.

In one or more embodiments of the invention, the phase change material may be a liquid including an aggregate. The aggregate may be solid particles or other structure dispersed in the liquid. The aggregate may, in the event of the formation of a passage way between an interior volume of the thermal energy storage pallet and an exterior environment, fill the passage way and thereby seal the passage way. The aggregate may be, for example, fibers, solid particles, or other materials. In other embodiments of the invention, the aggregate may be a material, dissolved in the liquid, that solidifies when the liquid is flowing through a passage way and thereby seals the passage way.

In one or more embodiments of the invention, the phase change material may be an aggregate. The aggregate may include discrete particles. Each discrete particle may include a material that acts as a phase change material that is encapsulated in an enclosure. A size of the enclosure may be selected so that that particles are unable to pass through a passage way of a size that is smaller than the size of the enclosure. For example, the particles may be 5 mm spherical particles. The size of the particles would prevent the particles from traversing a passage having a diameter of 4 mm and thereby prevent the phase change material from leaking out of the thermal energy storage pallet.

In still further embodiments of the invention, the phase change material may include a bladder, or other structure, that encapsulates a liquid that acts as the phase change material. The bladder may prevent the phase change material from leaking out of the thermal energy storage pallet.

Figure 3:
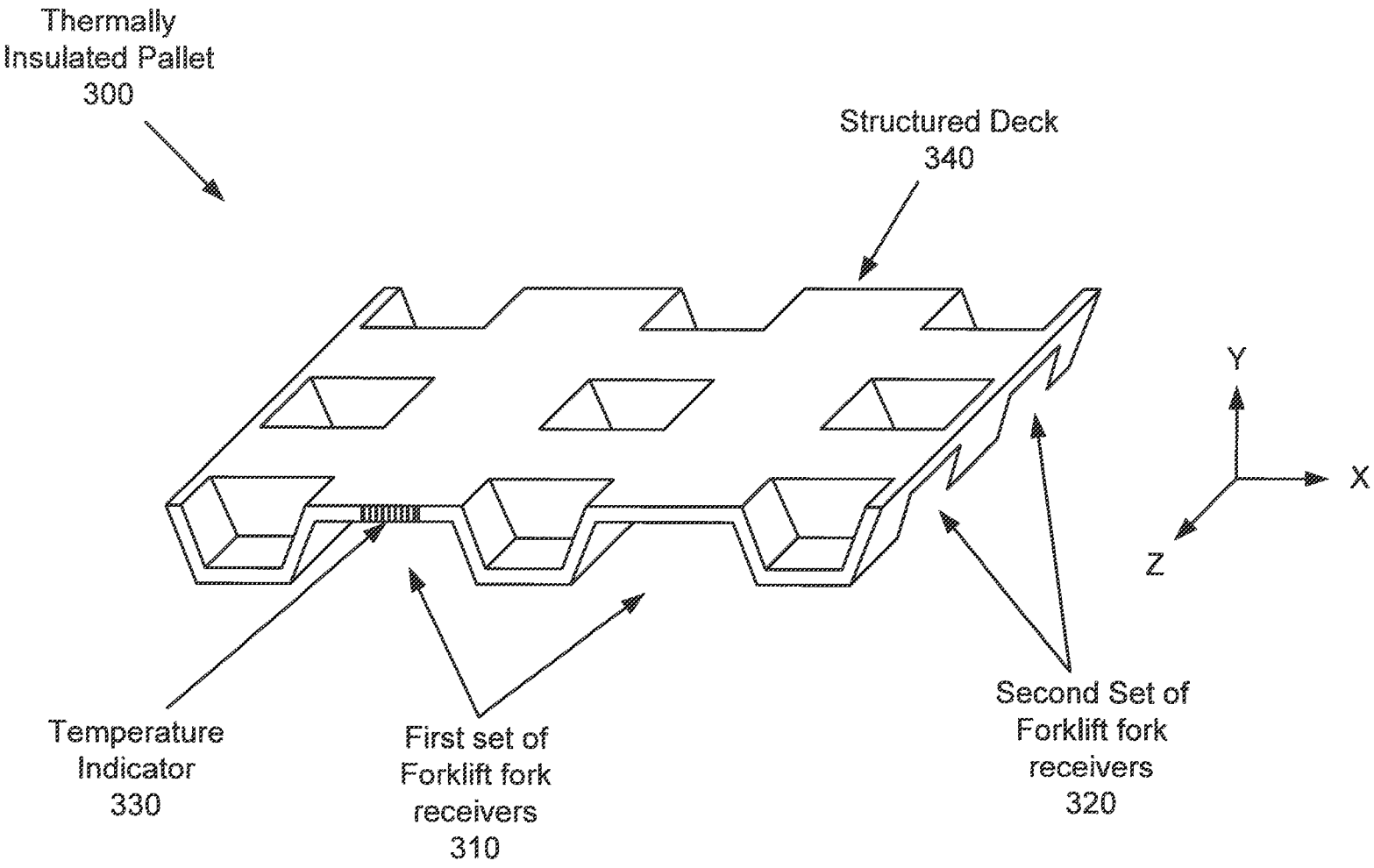
FIG. 3 shows an isometric diagram of a second thermal energy storage pallet in accordance with one or more embodiments of the invention.

FIG. 3 shows a second thermal energy storage pallet (300) in accordance with one or more embodiments of the invention. The second thermal energy storage pallet (300) includes a structured deck (340) and a temperature indicator (330) similar to the structured deck (110) and temperature indicator (130), respectively, shown in FIG. 1. Unlike the thermal energy storage pallet (100), shown in FIG. 1, the second thermal energy storage pallet (300) includes a first set of forklift fork receivers (310) and a second set of forklift fork receivers (320).

Figure 4:
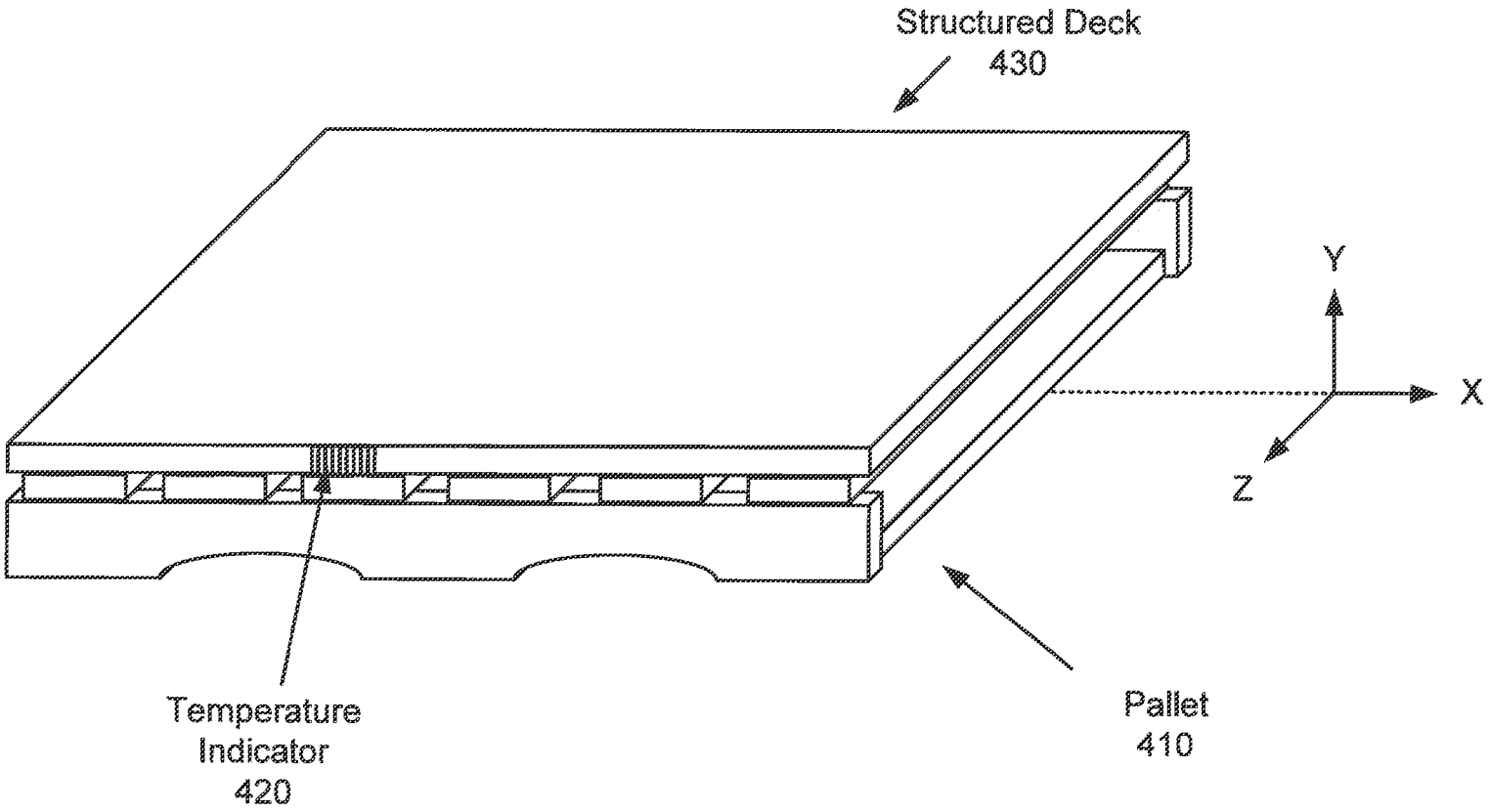
FIG. 4 shows an isometric diagram of a third thermal energy storage pallet in accordance with one or more embodiments of the invention.

Each set of forklift receivers are configured to receive forks from a forklift and thereby enable the second thermal energy storage pallet (100) to be easily transported using a forklift. The first set of forklift fork receivers (310) are aligned to a first axis, e.g., the Z axis, and the second set of forklift fork receivers (320) are aligned to a second axis, e.g., the X axis. Thus, the second thermal energy storage pallet (300) may be picked up from all four sides using a forklift, e.g., a four-way pallet, FIG. 4 shows a third thermal energy storage pallet in accordance with one or more embodiments of the invention. The third thermal energy storage pallet (300) includes a pallet (410), a temperature indicator (420), and a structured deck (430) that may be affixed or reversibly affixed to the pallet (410). Each of the components are described below.

The pallet (410) may be a physical structure for holding goods during shipping. The pallet (410) may be a wooden structure. The pallet (410) may have any shape or structure to hold the goods during shipping without departing from the invention.

The temperature indicator (420) is similar to the temperature indicator described with respect to FIG. 1.

The structured deck (430) is similar to the structured deck (110) shown in FIG. 1. Unlike the structure deck (110) shown in FIG. 1, the structured deck (430) is a planar structure or otherwise shaped to attach to the pallet (410). For additional details regarding the structured deck (430) see FIG. 5.

Figure 5:
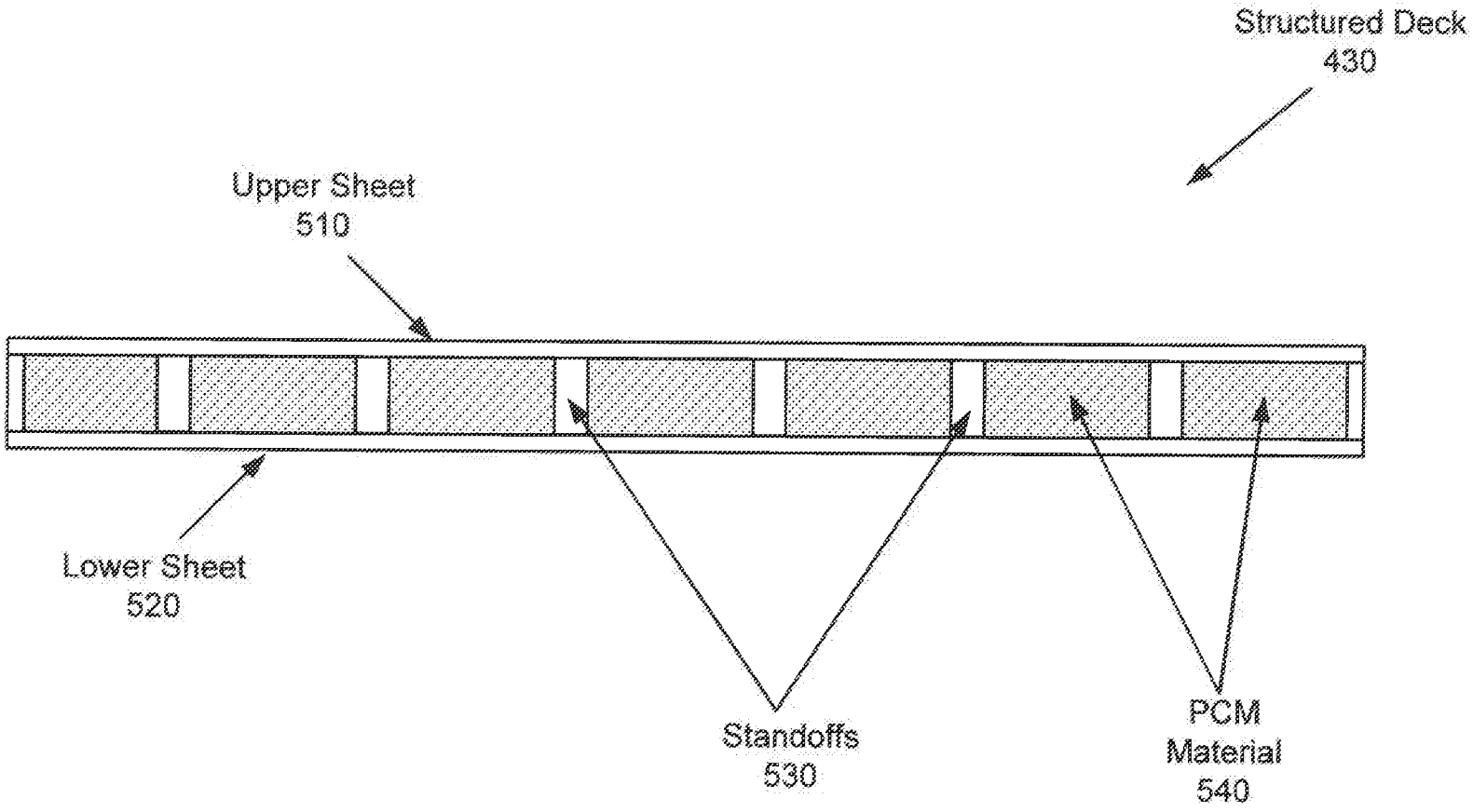
FIG. 5 shows a cross section diagram of a structured deck in accordance with one or more embodiments of the invention.

FIG. 5 shows a cross section diagram of the structured deck (430) shown in FIG. 4. The cross section shown in FIG. 5 is taken along the X-Y plane shown in FIG. 4. As seen from FIG. 5, the structured deck (430) includes an upper sheet (510), a lower sheet (520), standoffs (530), and phase change material (540).

Each of the aforementioned components is similar to the like named components shown in FIG. 1. However, the upper sheet (510) and lower sheet (520) are planar, or substantially planar to enable the structured deck (430) to attach to the standard wood or plastic pallet. In other embodiments of the invention, the structure deck (430) may be attached to other support structures without departing from the invention. For example, an additional support structure may be disposed between the structure deck (430)

and the pallet. In another example, the structure deck (430) may be attached to a second structure that serves a similar purpose to that of a pallet.

Figure 6:
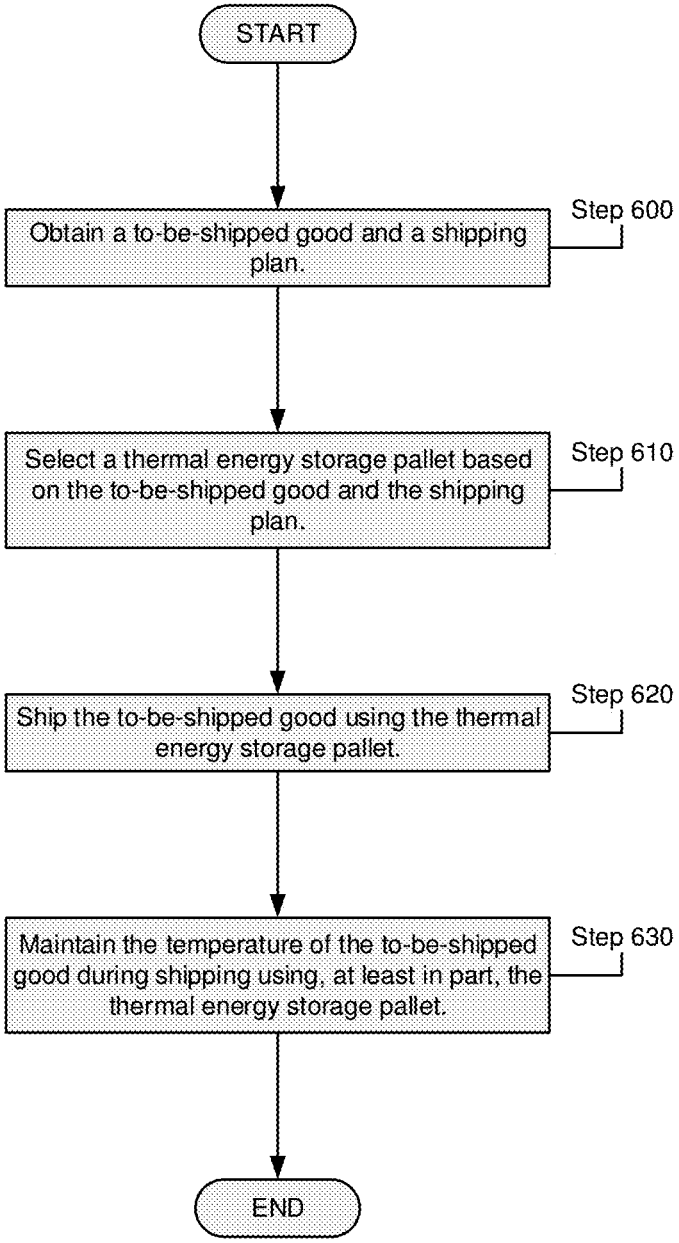
FIG. 6 shows a flowchart of a method of shipping goods in accordance with one or more embodiments of the invention.

FIG. 6 shows a flowchart in accordance with one or more embodiments of the invention. The method depicted in FIG. 6 may be used to ship goods in accordance with one or more embodiments of the invention. One or more steps shown in FIG. 6 may be omitted, repeated, and/or performed in a different order among different embodiments.

In Step 600, a to-be-shipped good and a shipping plan are obtained. The to-be-shipped good may be any type of good. For example, good to-be-shipped good may be wine, milk, produce, meat, dairy products, flowers, chocolate, and/or refrigerated goods. A quantity of the to-be-shipped good may also be obtained. The shipping plan may specify how the to-be-shipped goods will be shipped. For example, the shipping plan may specify segments of a shipping route, a duration of each shipping segment, and a type of conveyance used during each segment. The conveyance may be a type of container, a regulation temperature of the container, and/or an insulation rating of the container. The shipping plan may also specify other types of goods that are to be shipped in the shipment.

In Step 610, a thermal energy storage (TES) pallet is selected based on, at least in part, the to-be-shipped good and the shipping plan.

In one or more embodiments of the invention, the TES pallet is selected based on a regulation temperature of the to-be-shipped good. The regulation may be determined based on a type of the good. For example, each type of good may have an associated ideal shipping temperature that minimizes degradation of the good during shipping. The temperature of the good may be matched to a TES pallet that includes phase change material having a liquid to solid phase transition temperature at the same temperature as the regulation temperature of the good.

In one or more embodiments of the invention, the TES pallet is selected based on a regulation temperature specified by a conveyance used during the shipping. For example, during shipping a first segment of the shipping plan may specify that a good will be shipped in a refrigerated container having a regulation temperature of 40° Fahrenheit. The regulation temperature of the conveyance may be matched to a TES pallet that includes phase change material having a liquid to solid phase transition temperature at the same temperature as the regulation temperature of the conveyance.

In one or more embodiments of the invention, a thermal state of the selected TES pallet may be determined after the TES pallet is selected. The thermal state may be whether the phase change material disposed within the TES pallet is solidified. The thermal state may be determined by, for example, using a thermal state indicator of the TES pallet. If the thermal state of the TES pallet indicates that the phase change material is not solidified, the TES pallet may be chilled until the phase change material is solidified.

In one or more embodiments of the invention, TES pallets may be stored in a chilled environment to cause the phase change material disposed within the TES pallet to solidify before selection of the TES pallet.

In Step 620, the to-be-shipped goods are shipped using the selected TES pallet. The goods may be shipped by loading the goods onto or securing the goods to the TES pallet and then shipping them in accordance with the shipping plan.

In Step 630, the temperature of the to-be-shipped good is maintained during the shipping using, at least in part, the thermal energy storage pallet. Prior to the shipping, the goods may be stored on the pallet in a chilled space that solidifies a phase change material of the pallet.

Figure 7:
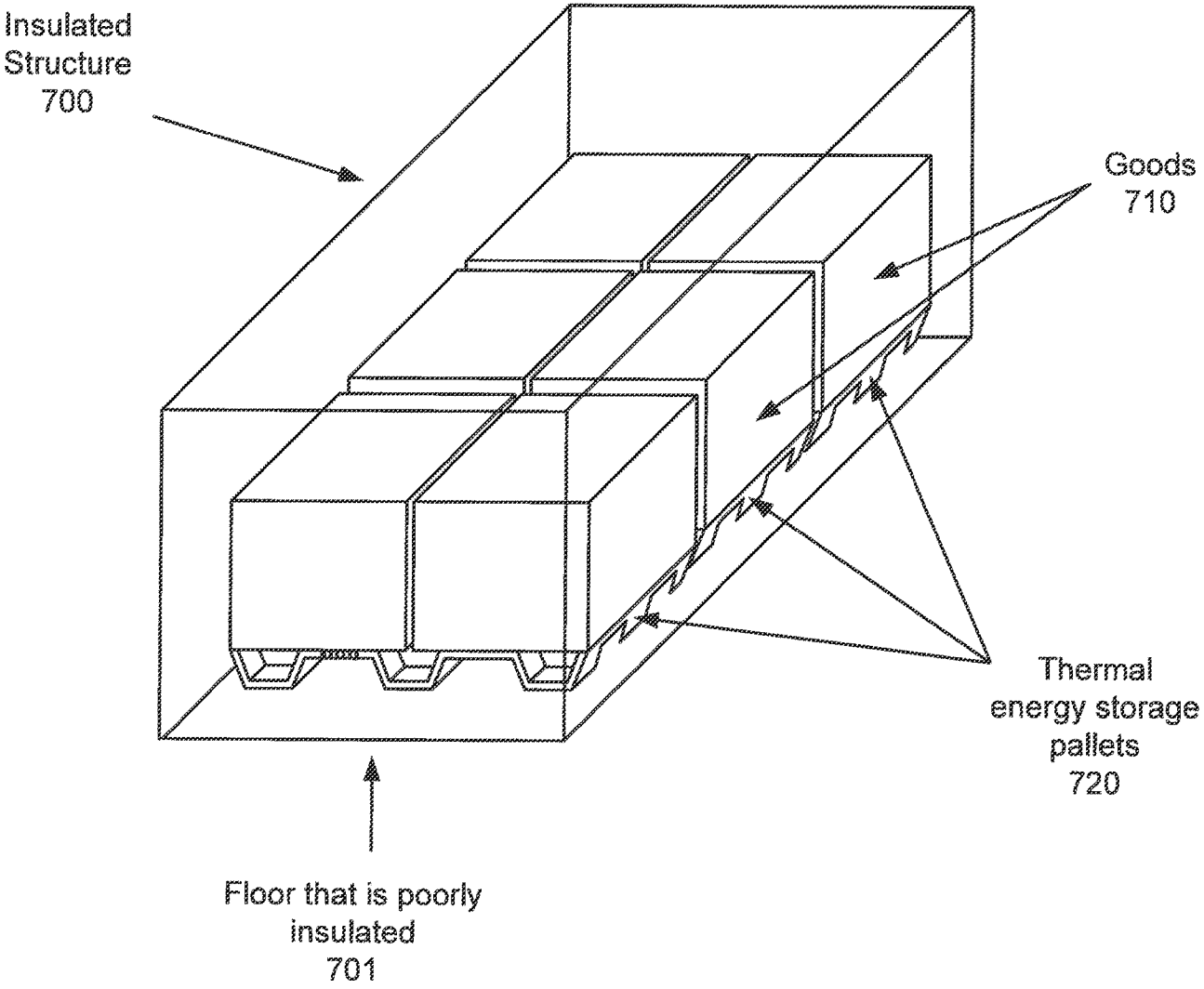
FIG. 7 shows an isometric diagram of an insulated structure in accordance with one or more embodiments of the invention.

In one or more embodiments of the invention, the TES pallet maintains the temperature of the to-be-shipped goods by shielding the goods from heat exchange with an ambient environment. FIG. 7 shows an example of an insulated structure (700) for shipping goods in accordance with embodiments of the invention. Goods (710) are loaded onto or secured to TES pallets (720). The TES pallets (720) and goods (710) are loaded into the insulated structure (700). To load the TES pallets (720) and goods (710), a floor (701) of the insulated structure (700) must be capable of supporting forklifts or other heavy equipment. Due to the structural requirements of the floor (701), the floor (701) is not thermally insulated unlike the other surfaces of the insulated structure (700).

The insulated structure (700) is shipped according to the shipping plan. During shipping, the insulated structure (700) is exposed to an ambient environment having a different temperature than the internal volume of the insulated structure (700). The temperature differential causes heat exchange between the internal volume of the insulated structure (700) and the ambient environment.

The five sides of the insulated structure (700) that are thermally insulated reduce the rate of heat exchange. Heat exchange through the floor (701) of the insulated structure (700) is not reduced due to the absence of thermal insulation. Placing the TES pallets (720) on the floor (701) shields the goods (710) from heat exchange through the floor (701). In response to heat exchange through the floor (701), the phase change material disposed within the TES pallets (720) may undergo a liquid to solid or a solid to liquid phase transition. By undergoing a phase transition, the phase change material may reduce the impact of heat exchange through the floor (701) has on a temperature of the goods (710).

While not shown in FIG. 7, some conveyances may include an active temperature regulation device such as a chilled air generation unit, an air conditioner, etc. While the active temperature regulation device may reduce the impact of heat exchange through the floor (701), a portion of the goods that are placed either directly or indirectly on the floor (701) may still exchange heat with the environment surrounding the insulated structure and thereby be degraded by temperature change. Placement of the TES pallets (720) between the goods (710) and the floor (701) may prevent the aforementioned heat exchange and maintain the portion of the goods that would otherwise be degraded.

One or more embodiments of the invention may provide one or more of the following advantages: i) a TES pallet in accordance with embodiments of the invention may improve the energy efficiency of a refrigeration system in which the TES pallet is disposed, ii) a TES pallet in accordance with embodiments of the invention may improve the energy efficiency of the on-board refrigeration unit, including diesel or other fuel consumption of on-board electrical generation, iii) a TES pallet in accordance with embodiments of the invention may improve the temperature stability inside a warehouse where the TES pallet is disposed, iv) a TES pallet in accordance with embodiments of the invention may improve food quality of refrigerated products by reducing the range of temperature fluctuations during storage, v) a TES pallet disposed in a conveyance in accordance with embodiments of the invention may improve the temperature stability inside the conveyance, vi) a TES pallet disposed in a conveyance in accordance with embodiments of the invention may improve the shelf life of fresh perishable items by providing greater temperature protection while in transit, vii) a TES pallet disposed in a conveyance in accordance with embodiments of the invention may absorb heat infiltration into the container reducing the thermal workload of the on-board refrigeration unit, viii) a TES pallet in accordance with embodiments of the invention may be stackable or nestable with other TES pallets to reduce storage space requirements, and ix) a TES pallet in accordance with embodiments of the invention may be reusable, cleanable, and reduce the cost of shipping by replacing a consumable portion of a shipping plan.

While the invention has been described above with respect to a limited number of embodiments, those skilled in the art, having the benefit of this disclosure, will appreciate that other embodiments can be devised which do not depart from the scope of the invention as disclosed herein. Accordingly, the scope of the invention should be limited only by the attached claims.

What is claimed is:

1. A thermal energy storage pallet comprising:

a first sheet formed with a first plurality of bends defining a first higher portion, a first lower portion, and first sidewalls;

a second sheet formed with a second plurality of bends defining a second higher portion, a second lower portion, and second sidewalls, the second plurality of bends matching the first plurality of bends;

wherein the first and second pluralities of bends define a plurality of recesses, the plurality of recesses operable to receive a fork of a forklift for moving the thermal energy storage pallet;

wherein the first sheet and the second sheet each formed of a rigid material to provide structural support for the thermal energy storage pallet;

a plurality of standoff members connecting the first and second sheets, wherein the plurality of standoff members are disposed between the first and second higher portion, between the first and second lower portions, and between the first and second sidewalls to provide further structural support for the thermal energy pallet;

wherein the first higher portion of the first sheet forms a structured deck onto which goods may be loaded for transport; and a phase change material disposed in compartments defined by and located between the first and second sheets and the plurality of standoff members, the phase change material operable to change state in response to heat exchange between the thermal energy storage pallet, the transported goods, and an environment surrounding the pallet.

2. The thermal energy storage pallet of claim 1, further comprising a temperature device operable to provide an indication of a temperature relating to one or more of the thermal energy storage pallet, the transported goods, and the environment.

3. The thermal energy storage pallet of claim 1, wherein at least some of the plurality of standoff members directly connect the first sheet and the second sheet.

4. The thermal energy storage pallet of claim 3, wherein the at least some of standoff members maintain a separation distance between the first sheet and the second sheet.

5. The thermal energy storage pallet of claim 1, wherein the first sheet and the second sheet are bonded, and wherein the bonding hermetically seals the compartments in which the phase change material is disposed.

6. The thermal energy storage pallet of claim 1, wherein the first sheet is formed of a thermal insulator.

7. The thermal energy storage pallet of claim 6, wherein the thermal insulator is a plastic.

8. The thermal energy storage pallet of claim 1, wherein the second sheet is formed of a thermal insulator.

9. The thermal energy storage pallet of claim 8, wherein the thermal insulator is a plastic.

10. The thermal energy storage pallet of claim 1, wherein the phase change material comprises:

a first material having a liquid to solid phase transition temperature; and a second material that modifies the viscosity of the first material.

11. The thermal energy storage pallet of claim 1, wherein the viscosity of the phase change material is greater than 100 centipoise.

12. The thermal energy storage pallet of claim 10, wherein the liquid to solid phase transition temperature is set at a desired temperature for the transported goods.

13. The thermal energy storage pallet of claim 10, wherein the liquid to solid phase transition temperature is at a shipping temperature.

* * * * *